343-700 MS AU 256 EX
2/7/78 OR 4,072,952

United States Patent [19]
Demko
[11] 4,072,952
[45] Feb. 7, 1978

[54] MICROWAVE LANDING SYSTEM ANTENNA

[75] Inventor: Paul S. Demko, Bricktown, N.J.
[73] Assignee: The United States of America as represented by the Secretary of the Army, Washington, D.C.

[21] Appl. No.: 729,431
[22] Filed: Oct. 4, 1976
[51] Int. Cl.² ..... H01Q 1/28; H01Q 1/38
[52] U.S. Cl. ..... 343/700 MS; 343/708; 343/729; 343/770
[58] Field of Search ..... 343/708, 831, 700 MS, 343/729, 770

[56] References Cited

U.S. PATENT DOCUMENTS

| | | | |
|---|---|---|---|
| 2,612,606 | 9/1952 | Wehner | 343/708 |
| 2,701,307 | 2/1955 | Cary | 343/708 |
| 3,210,764 | 10/1965 | Anderson et al. | 343/708 |
| 3,921,177 | 11/1975 | Munson | 343/854 |
| 3,945,013 | 3/1976 | Brunner et al. | 343/708 |
| 4,015,263 | 3/1977 | Koerner et al. | 343/708 |

*Primary Examiner*—Eli Lieberman
*Attorney, Agent, or Firm*—Nathan Edelberg; Sheldon Kanars; Bernard Franz

[57] ABSTRACT

A VHF/UHF communications blade type antenna additionally having microwave landing system (MLS) antenna elements mounted thereon and having the microwave feed components integral therewith to provide a composite structure adapted to function both as a communications and as a navigation antenna. The antenna is particularly adapted for use with aircraft which is to be retrofitted to include MLS capability.

11 Claims, 9 Drawing Figures

FIG. 1
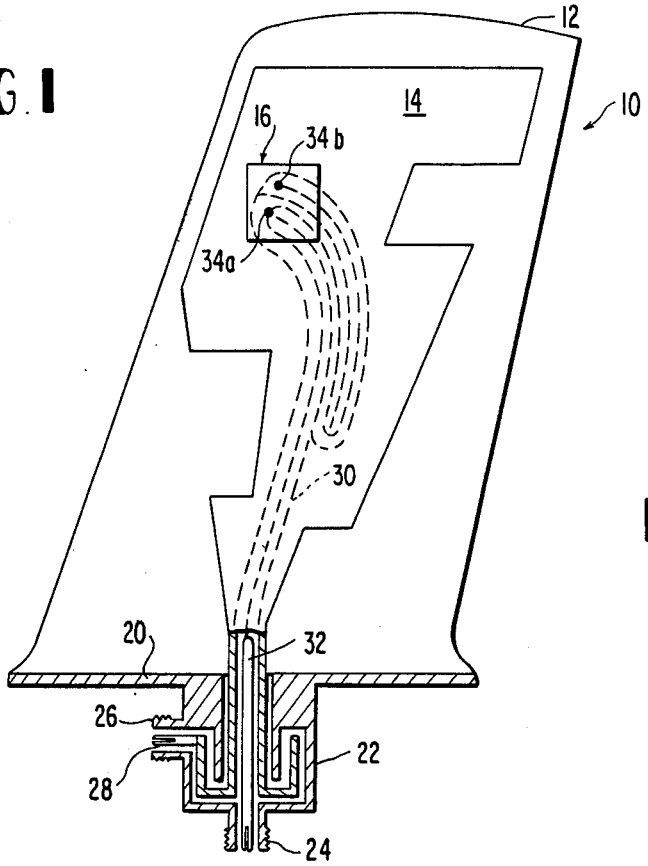
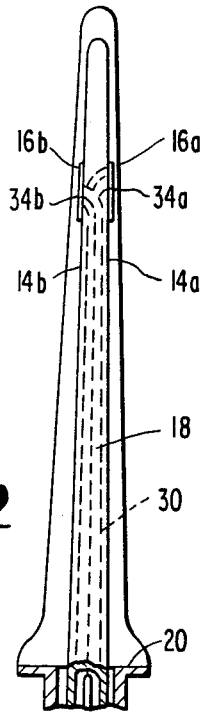
FIG. 2
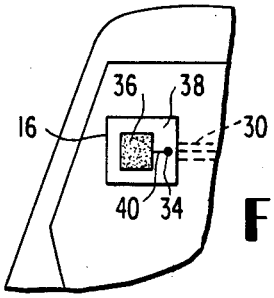
FIG. 4
FIG. 5
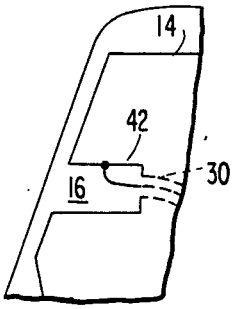
FIG. 3
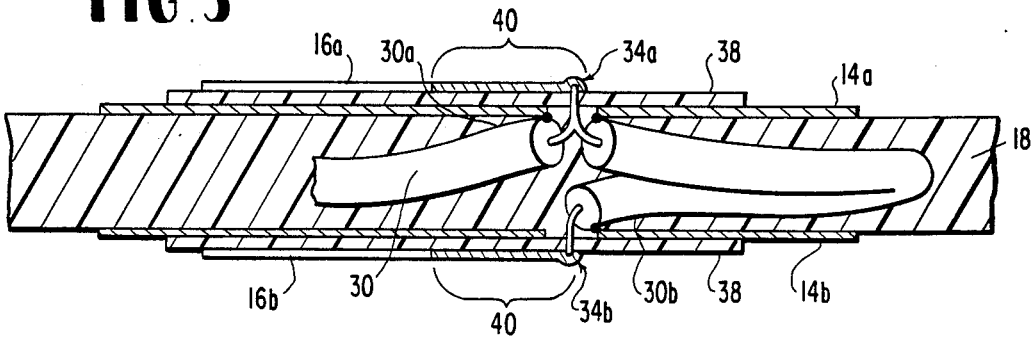

FIG. 6
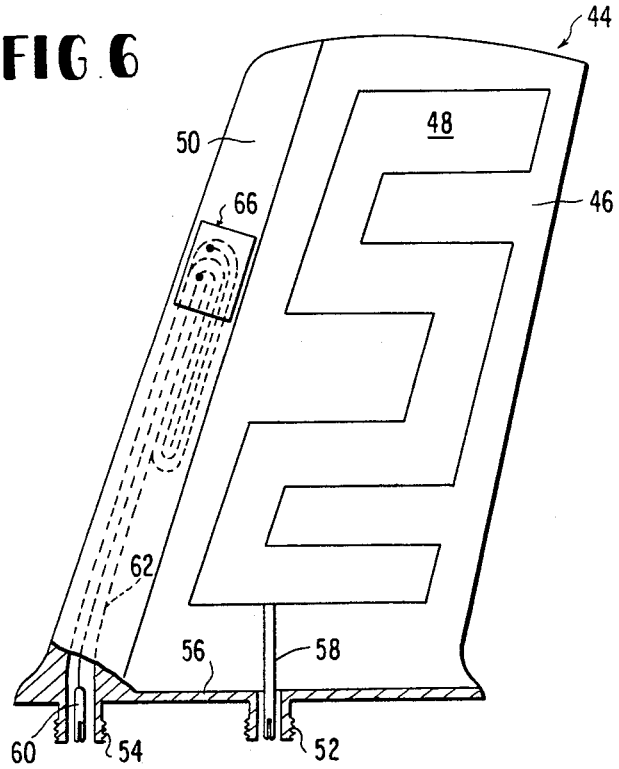
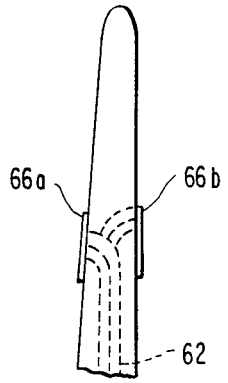
FIG. 7
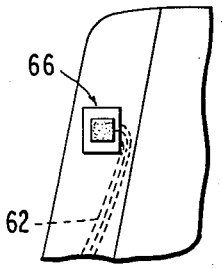
FIG. 8
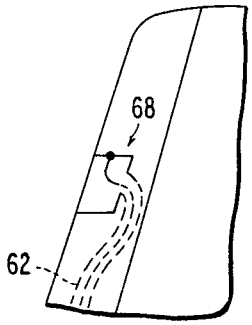
FIG. 9

MICROWAVE LANDING SYSTEM ANTENNA

The invention described herein may be manufactured and used by or for the Government for governmental purposes without the payment of any royalties thereon or therefor.

BACKGROUND OF THE INVENTION

This invention relates generally to antennas intended for mounting on aircraft and the like, and more particularly to an antenna structure having VHF/UHF capability as well as including microwave components for a microwave landing system for providing precise navagational guidance for the landing of aircraft in foul weather such as where the ceiling is less than 100 feet and visibilities less than one quarter of a mile exist.

Blade type aircraft antennas utilized for VHF and UHF communications are well known, a typical example of which is disclosed in U.S. Pat. No. 3,453,628, L.J. Dolan, entitled "Broadband Vibration Suppressed Aircraft Blade Antenna." Such an antenna comprises thin electrically conductive surfaces of predetermined patterns fabricated on opposite faces of a lamination of electrically insulating material and being fed by a flat strip coupler connected to a connector at the base of the assembly which mounts to the aircraft. Another example and one having a metal leading edge is disclosed in a publication entitled "A One-Eighth Blade Antenna With Metal Leading Edge," by Makato Ono, et al. published by the 1974 IEEE antennas Propagation Symposium.

It is an object of the present invention therefore to utilize such an antenna for the additional capability of providing an antenna mount for a microwave landing system.

It is also intended that other types of existing antennas such as L-band transponder or DME stubs, leading edge of aircraft control surfaces, and other elements capable of supporting the MLS components may be utilized without departing from the spirit and scope of the invention.

SUMMARY

Briefly, the subject invention is directed to an improvement in aircraft antennas which is adapted to operate not only with VHF/UHF communications equipment, but also with a microwave landing system and comprises mounting microwave antenna elements to both sides of a VHF/UHF radiator structure and having the microwave feed system for the microwave elements integral with the VHF/UHF radiator structure. Such an antenna is particularly adapted to be used as a retrofit antenna which will provide MLS capability without modifying existing aircraft structures.

BRIEF DESCRIPTION OF THE DRAWINGS

FIG. 1 is a side planar view partially in section of one embodiment of the subject invention;

FIG. 2 is a front planar view partially in section of the embodiment shown in FIG. 1;

FIG. 3 is a partial cross sectional view of the embodiment shown in FIG. 1;

FIG. 4 is a fragmentary side planar view further illustrative of the embodiment shown in FIG. 1;

FIG. 5 is a fragmentary side planar view illustrative of a modified form of the embodiment shown in FIG. 1;

FIG. 6 is a side planar view partially in section of a second embodiment of the subject invention;

FIG. 7 is a fragmentary front view of the embodiment shown in FIG. 6;

FIG. 8 is a fragmentary side planar view further illustrative of the embodiment shown in FIG. 6; and FIG. 9 is a fragmentary side planar view of a modified form of the embodiment shown in FIG. 6.

DESCRIPTION OF THE PREFERRED EMBODIMENT

Referring now to the drawings and more particularly to FIGS. 1–3 taken together jointly, reference numeral 10 denotes a blade type aircraft communications antenna having a dielectric radome 12 in the form of an airfoil within which two antennas, one 14 for VHF/UHF communications and one 16 for microwave landing system frequencies are included. Antenna 14 is a notched planar radiator comprised of two flat stripline conductive elements **14*a* and 14*b* fabricated on opposite faces of a flat dielectric member 18 having a predetermined thickness. The elements 14*a* and 14*b* constitute VHF/UHF radiating elements typical of well known blade antennas. The present invention, however, additionally includes a microwave antenna 16 formed from or mounted on the VHF/UHF antenna 14 at a predetermined height above a ground plane which comprises the antenna base 20. The base 20 also incorporates an RF isolation structure 22 having a connector 24 for microwave frequencies and a connector 26 for VHF/UHF frequencies forming a part thereof. The connector 26 includes a center conductor 28 which is coupled, for example, to the elements 14*a* and 14*b* by projecting through the dielectric member 18** intermediate the radiating elements.

A microwave feed network 30 configured from a coaxial cable as a balun or some such appropriate phasing network is coupled to the center conductor 32 of the microwave connector 24 and disposed between the VHF/UHF elements **14*a* and 14*b* within the dielectric member 18 where it terminates in a pair of microwave radiator elements which, for example, are shown as being comprised of microstrip patches 16*a* and 16*b* having electrical connections from the feed network 30 at the points 34*a* and 34*b* (FIG. 3). Each microstrip patch 16*a* and 16*b* comprises a substantially rectangular microstrip element 36 formed on one side of a relatively thin sheet of dielectric material 38, such as shown in FIG. 4. The microstrip element 36 additionally includes a short feed line and a small tab 40 for connection to the feed network 30. The outer conductors 30*a* and 30*b* of the feed network 30 shown in FIG. 3 is electrically connected to the VHF/UHF radiator elements 14*a* and 14which as such actually serve as one of the conductors, in this case the ground plane of the microwave antenna system. Due to the isolation structure 22** located at the base of the antenna and due to the bandwidth and frequency separation between the VHF/UHF and microwave elements, little if any interaction occurs between the lower VHF/UHF frequency and microwave elements.

The microwave radiating means thus far disclosed is not meant to be interpreted in a limiting sense, since other microwave elements and feed networks can be utilized as desired. For example, with reference to FIG. 5, a microwave slot 42 in the forward portion of each of the VHF/UHF radiating elements **14*a* and 14*b*** may be resorted to. Still other types of microwave elements, not shown, may be utilized such as shaped loops, dipoles, cavities, stripline radiators, etc. without departing from the spirit and scope of the invention. Additionally, polarization may be horizontal, vertical or right or left-hand circular as desired for operating frequencies between C-band (5 GHz) and Ku/band (15 GHz).

While the blade type of aircraft antenna shown in FIG. 1 discloses a dielectric radome with a dielectric leading edge, a similar type of blade antenna, but with one having a metal leading edge for protection against rain erosion and damage due to lightening, is shown in FIG. 6. Such an antenna is discussed in detail in the aforementioned Ono, et al. publication referenced above. In the instant antenna configuration designated by reference numeral 44 and shown in FIGS. 6 through 9, the forward portion of a dielectric radome 46 including a notched planar radiator 48 for VHF/UHF communications includes a metal leading edge 50, upon which or in which microwave landing system radiating elements already described are included. In this embodiment, two separate feed points comprising individual VHF/UHF connectors 52 and microwave connector 54 are shown included in a metallic antenna base 56, which forms the ground plane. The connector 52 includes an inner conductor 58 which couples to the notched planar VHF/UHF radiator configuration 48. The inner conductor 60 of the microwave connector 54 connects to a microwave feed network 62 which is enclosed inside or formed part of the leading edge 50 connecting to a MLS radiator assembly 64 comprised of a pair of radiators on either side of the leading edge as shown in FIGS. 7 and 8 and comprising, for example, microstrip patches 66*a* and 66*b*, in a manner identical to the antenna configuration described with reference to FIGS. 1 through 3. When desirable, other types of microwave radiating elements can be utilized such as shown by FIG. 9 wherein a portion of the metal leading edge is configured as a microwave slot radiator 68.

Thus the antenna according to the subject invention provides an outstanding advantage over the prior art in that no modification of existing aircraft structures need be undertaken to mount antennas providing MLS coverage whereas new separate antennas on aircraft for new frequency bands normally requires cutting new holes through stressed aircraft skins which becomes particularly difficult for high altitude aircraft having pressurization requirements. Such aircraft structures must often times be substantially stiffened and modified to accept new antennas. On the other hand, most aircraft already employ VHF or UHF communications blade type antennas and such aircraft could employ the subject antenna retaining not only the communications function of the antenna which it replaced, but additionally having the required MLS capability.

Having thus described what is at present considered to be the preferred embodiments of the subject invention,

I claim:

1. An antenna configuration for aircraft having a VHF/UHF antenna means enclosed within a dielectric radome which has an airfoil configuration attached to a base, the VHF/UHF antenna means being a blade type comprising a pair of like planar radiator elements located on opposite faces of a planar dielectric member, said base being adapted for mounting on the aircraft and acting as a ground plane, and having a VHF/UHF antenna and communications apparatus within the aircraft, the improvement comprising:

microwave antenna means for the Microwave Landing System comprising a pair of like microwave antenna elements located within said radome outside opposite faces of said dielectric member, a microwave signal feed point in said base, microwave feed means disposed interiorly of said radome coupling the microwave signal feed point to the microwave antenna elements, with the microwave feed means including phasing means to feed the microwave antenna elements in a desired phase relation, the phase relation and the location of the microwave antenna elements being that which produces a desired omnidirectional pattern as required for the Microwave Landing System.

2. An antenna configuration as claimed in claim 1, which is adapted to retrofit said microwave antenna means into an existing radome type having said VHF/UHF antenna means, without modification of the aerodynamic design, and without significant interference with the operation of said communications apparatus.

3. An antenna configuration as claimed in claim 2, wherein both signal feed points are integrally incorporated in a common feed point apparatus including frequency isolation means, and make use of only said existing opening through said base originally used for the VHF/UHF signal feedpoint.

4. An antenna configuration as claimed in claim 1, wherein said pair of microwave antenna elements comprises microstrip patches.

5. The antenna as defined by claim 1 wherein said planar radiator elements are comprised of notched planar radiator elements.

6. The antenna as defined by claim 5 wherein said pair of microwave antenna means comprises notched microwave antenna elements formed in said notched planar radiator elements.

7. The antenna as defined by claim 5 wherein said microwave antenna means comprises microstrip patches located on said planar radiator elements.

8. The antenna as defined by claim 1 wherein both signal feed points are integrally incorporated in a common feed point apparatus including frequency isolation means.

9. The antenna as defined by claim 1 wherein said dielectric radome includes a metal leading edge and wherein said microwave antenna means comprises a pair of microwave antenna elements located on opposing side faces of said metal leading edge.

10. The antenna as defined by claim 9 wherein said pair of microwave antenna elements compises microwave slot radiators fabricated on said metal leading edge.

11. The antenna as defined by claim 9 wherein said microwave antenna means comprises a pair of microstrip patches located on opposite faces of said metal leading edge.

* * * * *